US007207625B1

(12) United States Patent
Hardt, II et al.

(10) Patent No.: US 7,207,625 B1
(45) Date of Patent: Apr. 24, 2007

(54) TEACHER'S CHAIR

(75) Inventors: John C. Hardt, II, Belton, TX (US); Rolland M. Low, Harker Hts, TX (US)

(73) Assignee: Mooreco, L.P., Temple, TX (US)

( * ) Notice: Subject to any disclaimer, the term of this patent is extended or adjusted under 35 U.S.C. 154(b) by 0 days.

(21) Appl. No.: 11/475,946

(22) Filed: Jun. 28, 2006

Related U.S. Application Data

(63) Continuation-in-part of application No. 11/392,580, filed on Mar. 30, 2006.

(51) Int. Cl.
*A47B 83/02* (2006.01)

(52) U.S. Cl. ..... 297/125; 297/188.03; 297/188.01; 297/188.11

(58) Field of Classification Search ..... 297/188.01, 297/188.03, 188.04, 188.11, 124, 125
See application file for complete search history.

(56) References Cited

U.S. PATENT DOCUMENTS 345,710 A * 7/1886 Mason ..... 297/188.04
645,102 A * 3/1900 Jennings ..... 297/124
859,494 A * 7/1907 Hardesty ..... 297/188.03
1,269,967 A * 6/1918 Sill ..... 297/124
1,401,083 A * 12/1921 Jurkovich ..... 297/124
1,473,702 A * 11/1923 Guthridge ..... 297/124
1,505,829 A * 8/1924 Warnecke ..... 297/188.03
1,832,642 A * 11/1931 Leff ..... 297/188.1
2,550,811 A * 5/1951 Herbert ..... 297/124
3,213,467 A * 10/1965 Hubbard ..... 297/188.13

* cited by examiner

*Primary Examiner*—Peter R. Brown
(74) *Attorney, Agent, or Firm*—The Nath Law Group; Jerald L. Meyer; Derek Richmond

(57) ABSTRACT

Disclosed is a chair that includes a support assembly. The support assembly should have a seat that is positioned on its top and should also have a back rest extending upward from the support assembly adjacent a side of the seat. Also, at least one storage compartment can be in sliding communication with the support assembly. And the disclosed chair can also include a clothes-hanger positioned on a top portion of a back surface of the back rest.

22 Claims, 8 Drawing Sheets

TEACHER'S CHAIR

This is a continuation-in-part of U.S. patent application Ser. No. 11/392,580, which was filed on Mar. 30, 2006.

FIELD OF THE INVENTION

This invention is related to a portable chair used by substitute teachers in a classroom setting. In particular, the present invention relates to an apparatus for assisting a substitute or mobile teacher or presenter when moving from one location to another while desiring to maintain files, clothes and miscellaneous items in an organized manner.

SUMMARY OF THE INVENTION

Embodiments of the inventive teacher's chair include a support assembly having a seat. The seat is positioned on top of the support assembly and can be made rotatable in one hundred and eighty degrees. The support assembly (or the seat) can also include an upwardly extending backrest that is positioned adjacent a side of the seat. At least one storage compartment can be in sliding communication with the support assembly. Also, a clothes-hanger can be positioned on a top portion of a back surface of said back rest.

Additional embodiments of the inventive chair can include any number of additional storage compartments. For example, at least one storage compartment, which can be a hanging file folder system, can be placed within the support assembly. This storage compartment can be made accessible or replaceable by including a sliding track that will allow the storage compartment to slide out of the support assembly. The compartment can then be accessed from above. The compartment can have an open top like a crate or can have a lid. Also, the storage compartment can be accessible from the side either with an open side or with a side door. Further, an additional storage compartment can be included within the support assembly. Like the original storage compartment, the additional storage compartment can include a sliding track so that the additional storage compartment is slidable out of the support assembly for accessibility or replacement. Additional storage compartments can be placed on the back surface of the back rest. The storage compartments that are placed on the back surface of the backrest can be made like a vertical file rack.

The sliding track of each compartment should have at least one detent mechanism that prevents the storage compartments from inadvertently sliding out of the support assembly. For example, if the storage compartment includes wheels that engage a sliding track fixed to the support assembly, the sliding track could include small raised constrictions that prevent the storage compartments from becoming disengaged from the sliding tracks.

Additional features of this embodiment of the inventive chair can include a footrest, which can be on a front portion of the support assembly. Alternatively, the footrest can be positioned all around the support assembly in one hundred and eighty-degrees in the case where the seat is made rotatable. The footrest should be used where an embodiment of the present inventive chair is configured as a stool or a taller chair. However, a footrest is not required to properly use the inventive chair.

Also, for ease of mobility of this embodiment, the support assembly can include casters and a handle. The handle can be positioned anywhere on the chair. Typically, however, a handle will be placed at a top portion of the backrest either integrally with the backrest or attached to the backrest. A handle can also be made integral with the clothes-hanger. Alternatively, the clothes-hanger can be used as a handle or the clothes hanger can have a handle attached thereto. Also, a hook can be integrated into the clothes-hanger or the handle.

An additional embodiment of the present inventive apparatus is a teacher chair including a wheeled support structure that supports a backrest. The support structure encompasses a file drawer. The file drawer can be slidingly positioned on two opposing sliding tracks within the support structure. Similarly, a storage tub can be slidingly positioned on two opposing sliding tracks within the support structure. Also included in this embodiment is a clothes-hanger shaped attachment in communication with an upper back portion of the backrest. Additionally, at least one vertical file rack positioned on a back side of the support structure.

Additional features of this embodiment of the inventive chair can include a footrest, which can be on a front portion of the support assembly. Alternatively, the footrest can be positioned all around the support assembly in one hundred and eighty-degrees in the case where the seat is made rotatable. The footrest should be used where an embodiment of the present inventive chair is configured as a stool or a taller chair.

Also, for ease of mobility of this embodiment, the support assembly can include casters and a handle. The handle can be positioned anywhere on the chair. Typically, a handle will be placed at a top portion of the backrest either integrally with the backrest or attached to the backrest. A handle can also be made integral with the clothes-hanger. Either the clothes-hanger can be used as a handle or the clothes hanger can have a handle attached thereto. Also a hook can be integrated into the clothes-hanger or the handle.

A method of using a teacher's chair can include providing a teacher's chair that has a support structure that supports a backrest. The backrest can include a clothes-hanger and the support structure can slidingly engage with a tub. The method of using the teacher's chair should involve sliding the tub out of the support structure, inserting an item into the tub and then sliding the tub back into the support structure. Additionally, the clothes-hanger should be used as a handle to help in relocating the teacher's chair.

A yet further embodiment of the teacher's chair includes a support assembly that has two upwardly extending members. A handle is positioned between the two upwardly extending members and a back support member is integrally connected, by one of its edges, to the handle. The back support member is reconfigurable between a first backrest position and a second tray position. The second tray position is parallel to a floor. Additionally, a clothes-hanger, which has a purse hook, is positioned on a top portion of the support assembly.

Variations of the teacher's chair include at least one hanging folder storage compartment. A first sliding additional storage compartment is installed in an interior portion of the support assembly. At least one secondary storage compartment, which is a vertical file rack, is included on the back surface of the backrest. To keep the storage compartment from inadvertently sliding out of the support assembly, a detent mechanism is included in the storage compartment. A footrest is included on a front portion of the support assembly; and casters are included on a lower portion of the support assembly.

An additional embodiment of the teacher's chair includes a wheeled support structure that has at least two upwardly extending members. A back support member is positioned between the two upwardly extending members. The back support member is rotatable from a back rest position to a utility tray position. A file drawer is encompassed by the wheeled support structure.

Variations of this further embodiment of the teacher's chair include a clothes-hanger positioned on a top portion of a back surface of the backrest. Two opposing sliding tracks within the support structure are included to support the file drawer. A storage tub, which is supported by two additional opposing sliding tracks, is included within the support structure. At least one vertical file rack is positioned on a back side of the support structure; and a footrest is on a front portion of the support structure.

With respect to the back support member, a back support member relief is included thereon. The back support member relief is in communication with the upwardly extending members when said back support member is in a back rest position to provide lateral stability for the back support member. The back support member also includes at least one back support member relief-stop at an end of the back support member relief. The back support member relief-stop has a substantially planar surface on one side and a body conforming surface on an opposite side and is in communication with the upwardly extending members when the back support member is in a utility tray position.

DETAILED DESCRIPTION

The word "exemplary" is used herein to mean "serving as an example, instance, or illustration." Any embodiment described herein as "exemplary" is not necessarily to be construed as preferred or advantageous over other embodiments.

Figure 1:
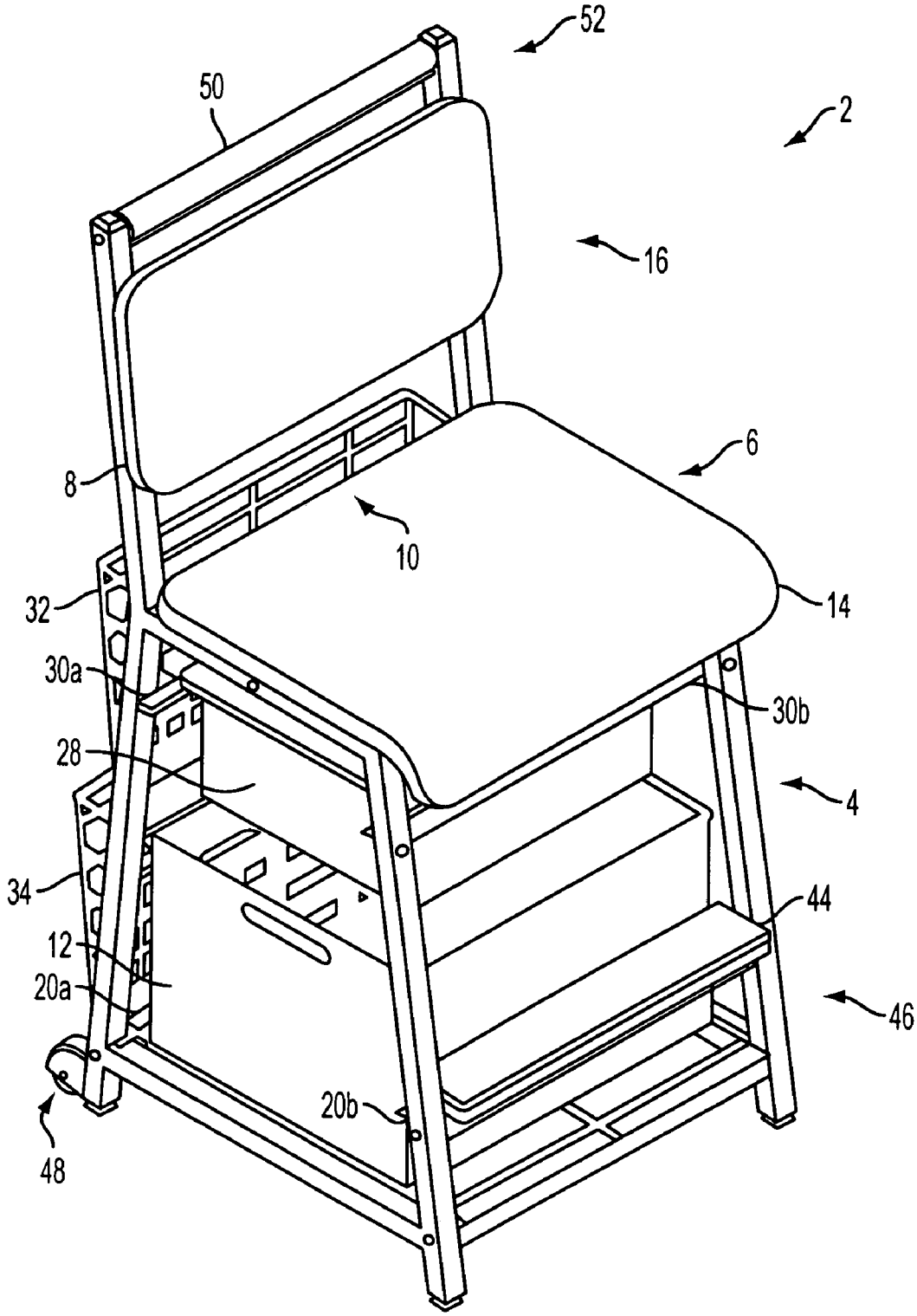
FIG. 1 shows a perspective view of an embodiment of the teacher's chair.
Figure 2:
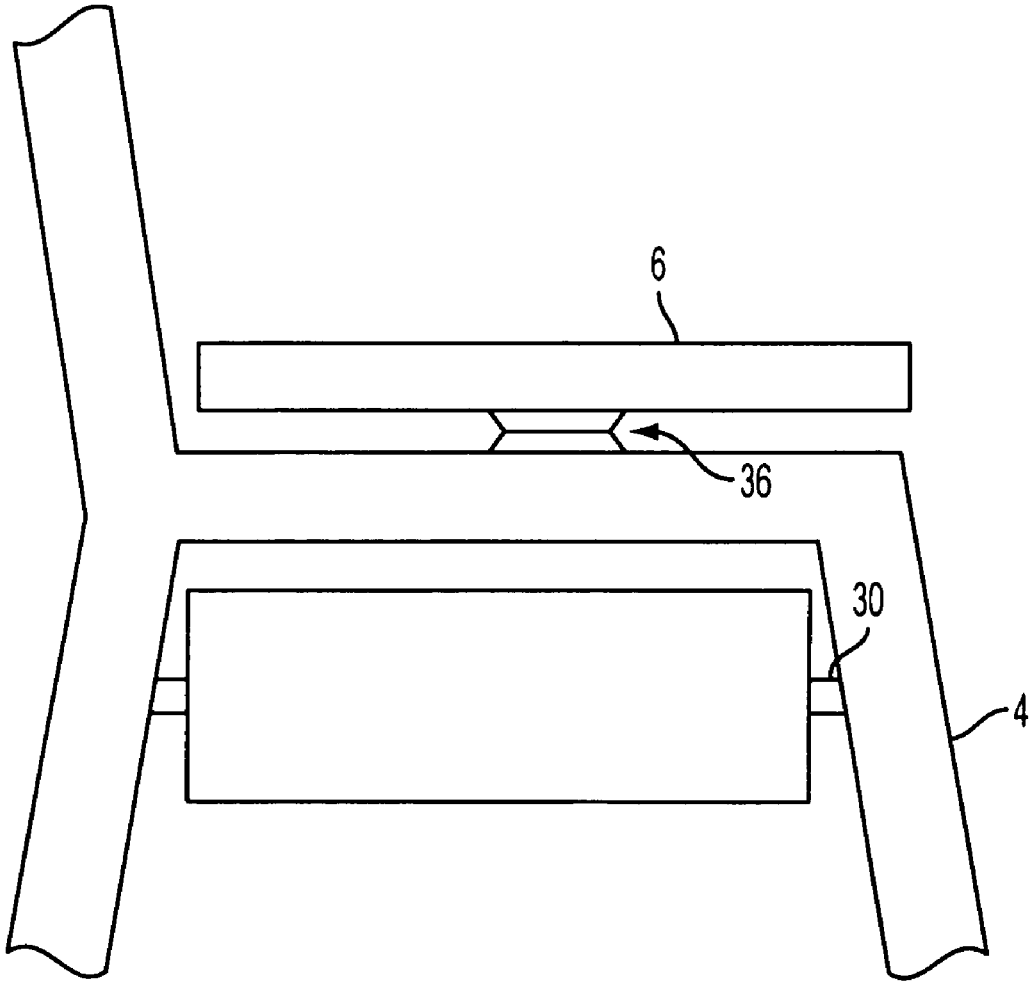
FIG. 2 shows a seat in rotating communication with a support assembly through an axle.

As shown in FIG. 1, a first embodiment of the inventive teacher's chair 2 can include a support assembly 4 having a seat 6. The seat 6 can be completely planar or it can have a lip 14 that conforms to the curve of a person's leg when seated on the seat 6. The seat 6 is positioned on top of the support assembly 4 and can be made rotatable in one hundred and eighty degrees with the use of a spindle or an axle 36 (shown in FIG. 2). The spindle 36 can be placed between the support assembly 4 and the seat 6 to allow for the one-hundred and eighty degree rotation of the seat 6 about an axis perpendicular to the seat 6. The support assembly 4 (or the seat 6) can also include an upwardly extending backrest 8 that is positioned adjacent a side 10 of the seat 6. At least one storage compartment 12 can be in sliding communication with the support assembly 4.

Figure 3A:
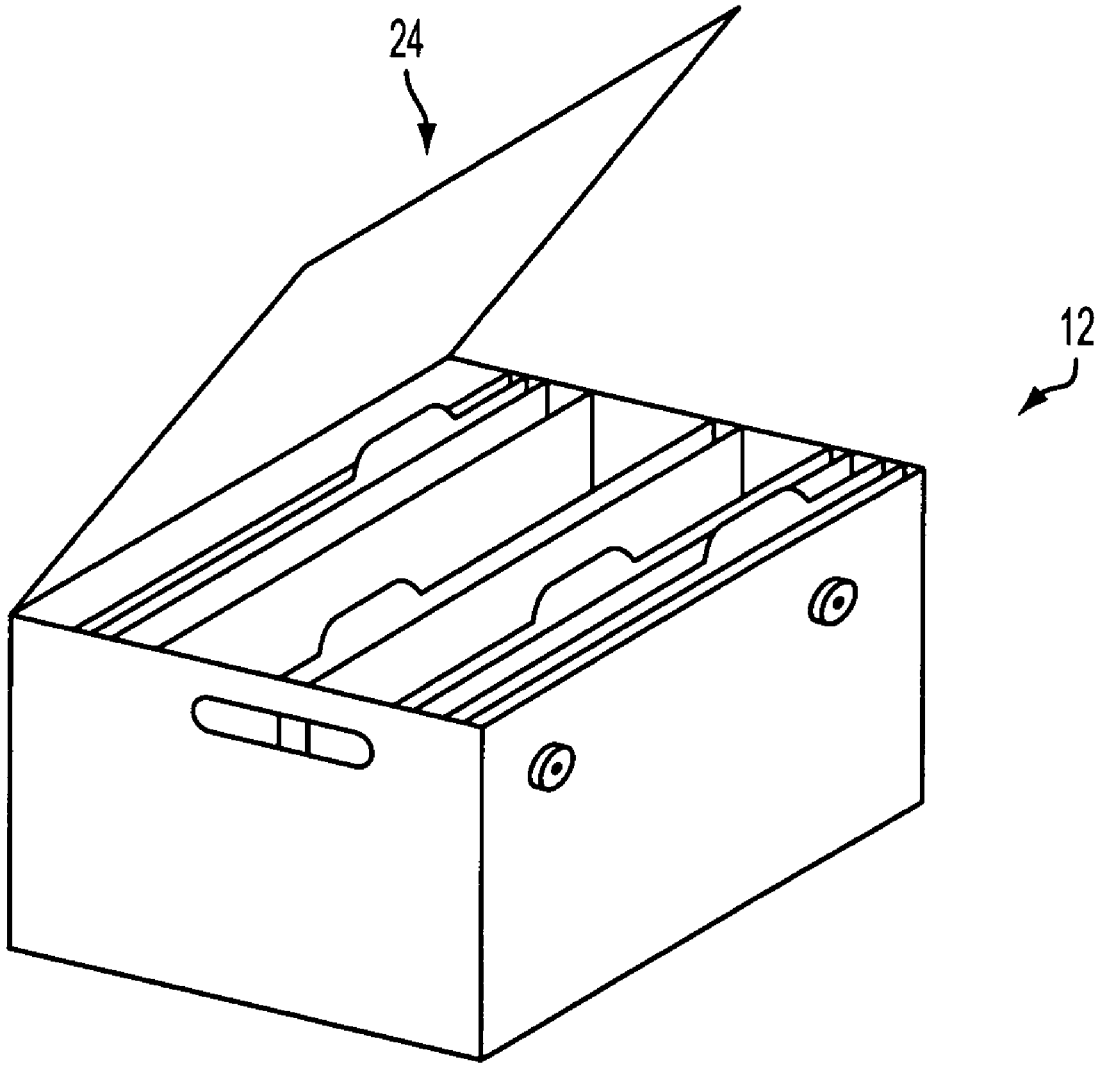
FIG. 3*a* shows a storage compartment having a top lid.
Figure 3B:
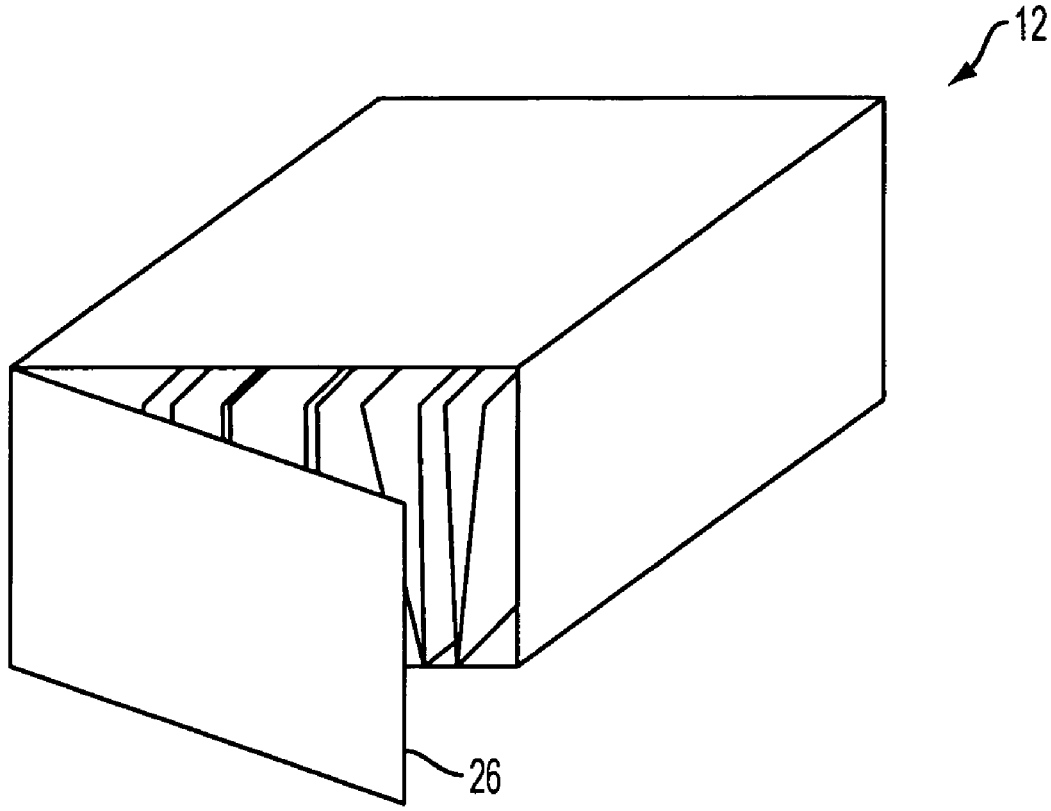
FIG. 3*b* shows a storage compartment having a side lid.

Additional storage compartments can be added to the inventive chair. For example, at least one storage compartment 12, which can be a hanging file folder system, can be placed within the support assembly 4. This storage compartment 12 can be made accessible or replaceable by including a first set of sliding tracks 20*a* and 20*b* that will allow the storage compartment 12 to slide out of the support assembly 4. The storage compartment 12 can then be accessed from above. The storage compartment 12 can have an open top 22 like a crate or can have a lid 24 as shown in FIG. 3*a*. Also, when the chair is constructed without a sliding track or when it is inconvenient to slide the storage compartment 12 out of the support assembly 4, the storage compartment 12 can be accessible from the side either with an open side or with a side door 26 as shown in FIG. 3*b*.

Further, an additional storage compartment 28 can be included within the support assembly 4. Like the first storage compartment 12, the additional storage compartment 28 can include a second set of sliding tracks 30*a* and 30*b* so that the additional storage compartment 28 is slidable out of the support assembly 4 for accessibility or replacement. Or, additional storage compartments 32 and 34 can be placed on the back surface 18 of the back rest 8. The storage compartments 32 and 34 that are placed on the back surface 18 of the backrest 8 can be made like a vertical file rack.

Figure 4:
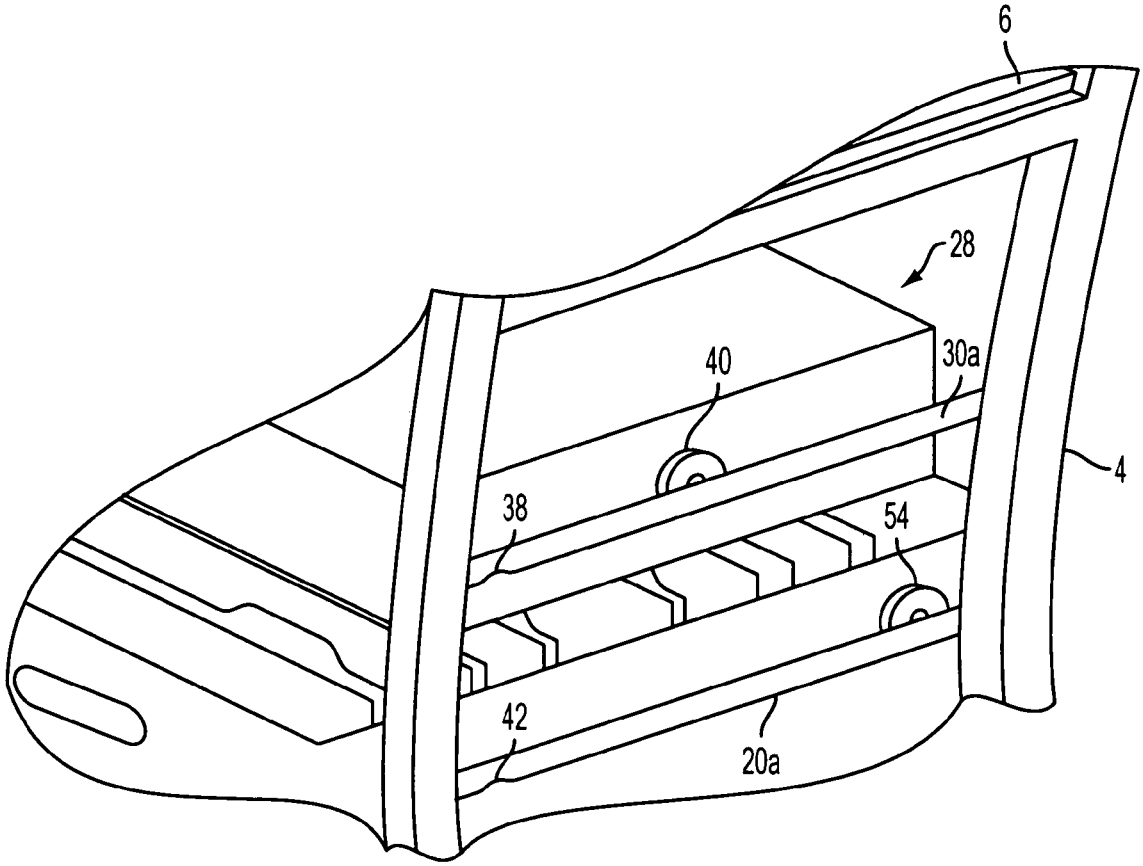
FIG. 4 shows a first sliding track and a second sliding track positioned inside of a support assembly.

As shown in FIG. 4, the sets of sliding tracks 20*a*, 20*b* and 30*a*, 30*b* of each compartment 12 and 28 should have at least one detent mechanism that prevents the storage compartments 12 and 28 from inadvertently sliding out of the support assembly 4. For example, as shown in FIG. 4, the additional storage compartment 28 includes an additional storage compartment wheel 40 that engages the sliding track 30*a* fixed to the support assembly 4 (a second wheel is similarly engaged on an opposite side of the storage compartment 28). The sliding track 30*a* could include a raised constriction 38 that prevents the storage compartment 28 from becoming disengaged from the sliding track 30*a*. Similarly, the storage compartment 12 includes a storage compartment wheel 54 that engages the sliding track 20*a* fixed to the support assembly 4 (a second wheel is similarly engaged on an opposite side of the storage compartment 12). The sliding track 20*a* can include a second raised constriction 42 that prevents the storage compartment 12 from becoming disengaged from the sliding track 20*a*.

Alternatively, a fixed storage compartment 12 or a fixed additional storage compartment 28, i.e. a storage compartment that is not in sliding communication with the support assembly 4 or at least one that does not have a sliding track, can be used in the inventive chair and the additional storage compartment can be a sliding storage compartment. Or both storage compartments can be fixed. In either case, the fixed storage compartment should have a side door 26 that can be used since it is not necessary (or possible without damaging the inventive chair) to slide the storage compartment out of the support assembly 4 to gain access to the contents of the storage compartment.

With continued reference to FIG. 1, additional features of this embodiment of the inventive chair can include a footrest 44, which can be on a front portion 46 of the support assembly 4. Alternatively, the footrest 44 can be positioned all around the support assembly 4 in one hundred and eighty-degrees in the case where the seat 6 is made rotatable. The footrest 44 should be used where an embodiment of the present inventive chair 2 is configured as a stool or a taller chair. However, the type of footrest used with the inventive chair is not limited to or based on a specific chair configuration.

Also, for ease of mobility of this embodiment, the support assembly 4 can include casters 48 and a handle 50. The handle 50 can be positioned anywhere on the chair 2. Typically, the handle 50 will be placed at a top portion 52 of the backrest 8 either integrally with the backrest 8 (not shown) or attached to the upper portion 16 of the chair 2.

Figure 5:
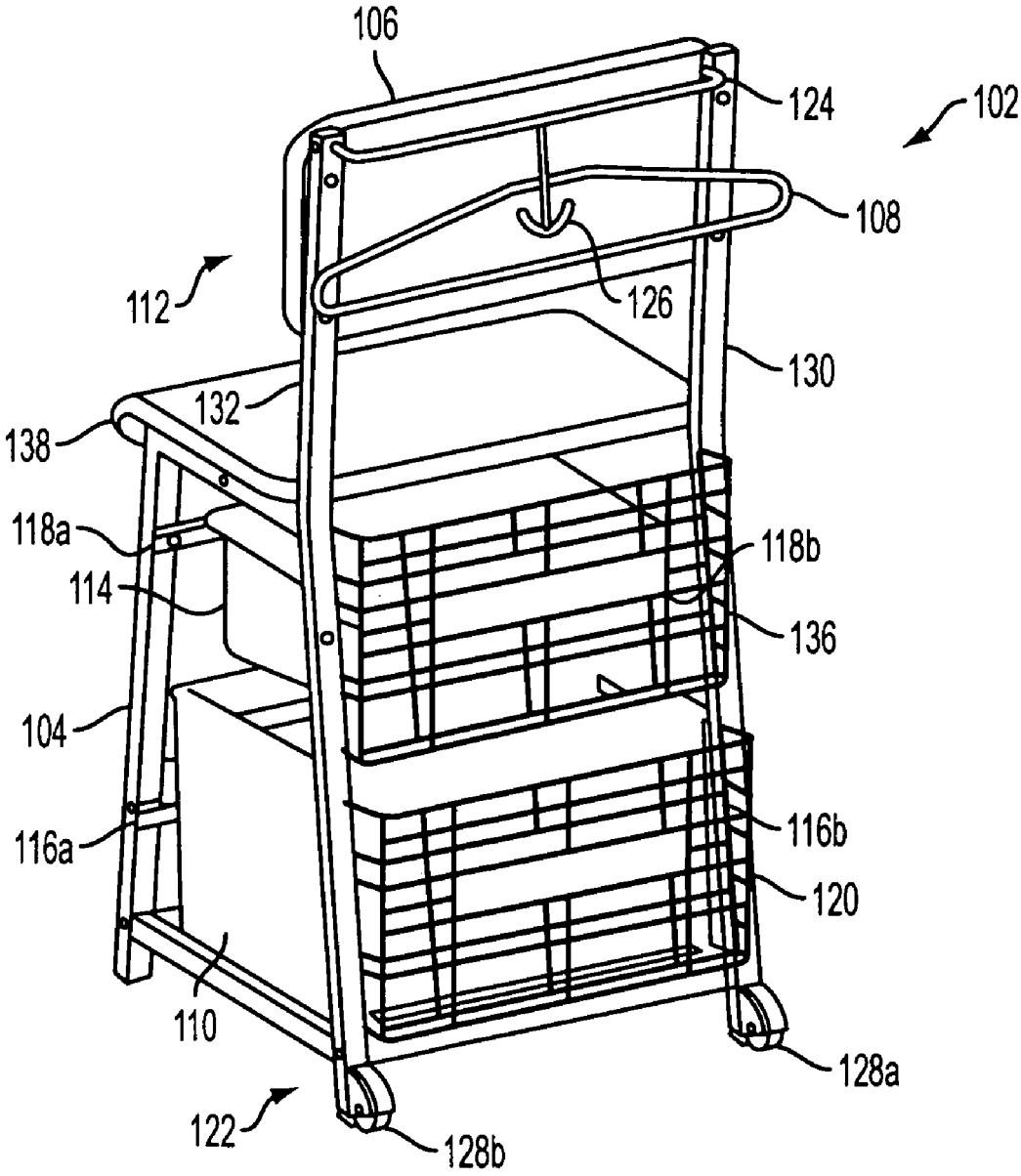
FIG. 5 shows an additional embodiment of the inventive teacher's chair.

An additional embodiment of the present inventive apparatus is depicted in FIG. 5 as a teacher chair 102 that includes a wheeled support structure 104. The wheeled support structure 104 has two upwardly extending members 130 and 132 that support a backrest 106 having a clothes-hanger 108 attached to an upper back portion 112 of the backrest 106. The wheeled support structure 104 encompasses at least one file drawer 110 and includes casters 128*a* and 128*b*.

Similar to the previous embodiment, the seat 106 can be completely planar or it can have a lip 138 that conforms to the curve of a person's leg when seated on the seat 106. Also, the seat 106 can be made rotatable in one hundred and eighty degrees with the use of a spindle or an axle 36 (shown in FIG. 2).

The file drawer 110 can be slidingly positioned on two opposing sliding tracks 116*a* and 116*b* within the support structure 104. A storage tub 114 can be included in the support structure 104 in addition to the file drawer 110. The storage tub 114 can be configured similarly to the file drawer 110 such that it is slidingly positioned on two opposing sliding tracks 118*a* and 118*b* within the support structure 104. Additionally, at least one vertical file rack 120 positioned on a back side 122 of the support structure 104. The vertical file rack 120 can be positioned on a lower portion 134 of the back side of the chair 102 to make room for an additional file rack 136 that can be positioned immediately above it.

A handle 124 can be included on the upper back portion 112 of the back rest 106. The handle 124 can be used as an aid to relocate the teacher's chair 102 and can be made integral with the clothes-hanger 108 as shown in FIG. 3 or it can be made as a feature separate from the clothes hanger 108. Also a hook 126 can be integrated into the clothes-hanger 108 or the, handle 124 or the backrest 106.

Additional features of this embodiment of the inventive chair can include a footrest (not shown), which can be on a front portion of the support assembly 104. Alternatively, the footrest can be positioned around the support assembly 104 in one hundred and eighty-degrees. The footrest should at least be used where an embodiment of the present inventive chair is configured as a stool or a taller chair.

Figure 6:
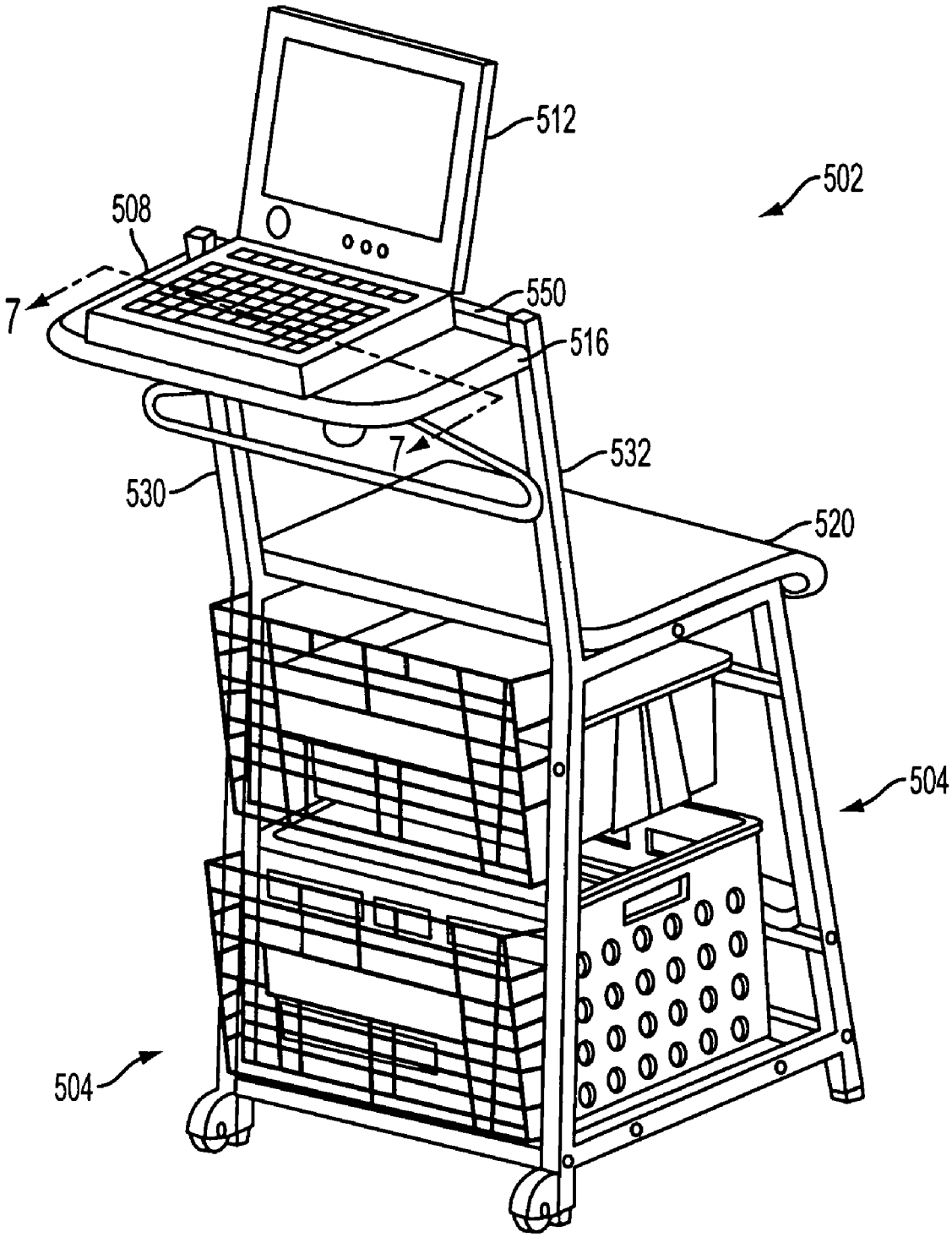
FIG. 6 shows a yet further embodiment of the inventive teacher's chair where a back support member is configured to be a utility tray.

An additional embodiment of the teacher's chair 502 is shown in FIG. 6. The additional embodiment of the teacher's chair 502 includes a support structure 504, which includes members 530 and 532 that extend upwardly from the support structure, and a handle 550 positioned between the upwardly extending members 530 and 532. The handle 550 is integrally connected to a back support member 508. When the back support member 508 is in a chair configuration, it will appear as similarly shown in the embodiment depicted in FIG. 5 as backrest 106. The back support member 508 can be rotated about an axis defined by handle 550 to a utility tray configuration as shown in FIG. 6. Thus, in a utility tray configuration, the back support member 508 can support a laptop computer, book, file, or any other item. The utility tray configuration is not limited to that depicted in FIG. 6, but can be such that the tray is in any position relative to the support frame 504. Any of the earlier described embodiments that do not have a back support member capable of rotating to a utility tray position can be retrofit by removing the handle (of the earlier embodiment) and replacing it with the combined back support member 508/handle 550 of the present embodiment.

Figure 7A:
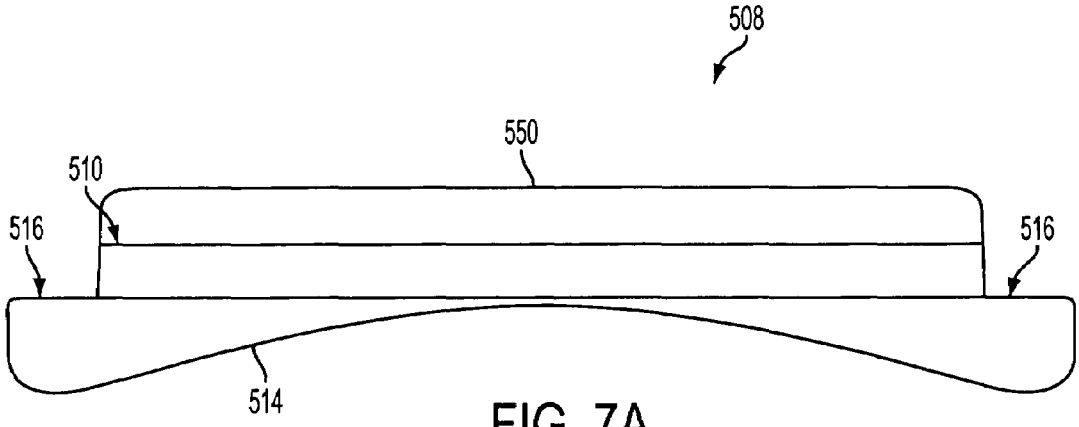
FIG. 7*a* shows a cross-section of the back support member taken along line 7—7 as shown in FIG. 6.

As shown in FIG. 7*a*, the back support member 508 has a cross-section such that a tray surface 510 of back support member 508 is substantially planar to support items such as a laptop computer 512 or other item. A body conforming surface 514 of back support member 508 is opposite the tray surface 510 and is configured to substantially conform to the shape of a person's back when seated in the Teacher's Chair.

Figure 7B:
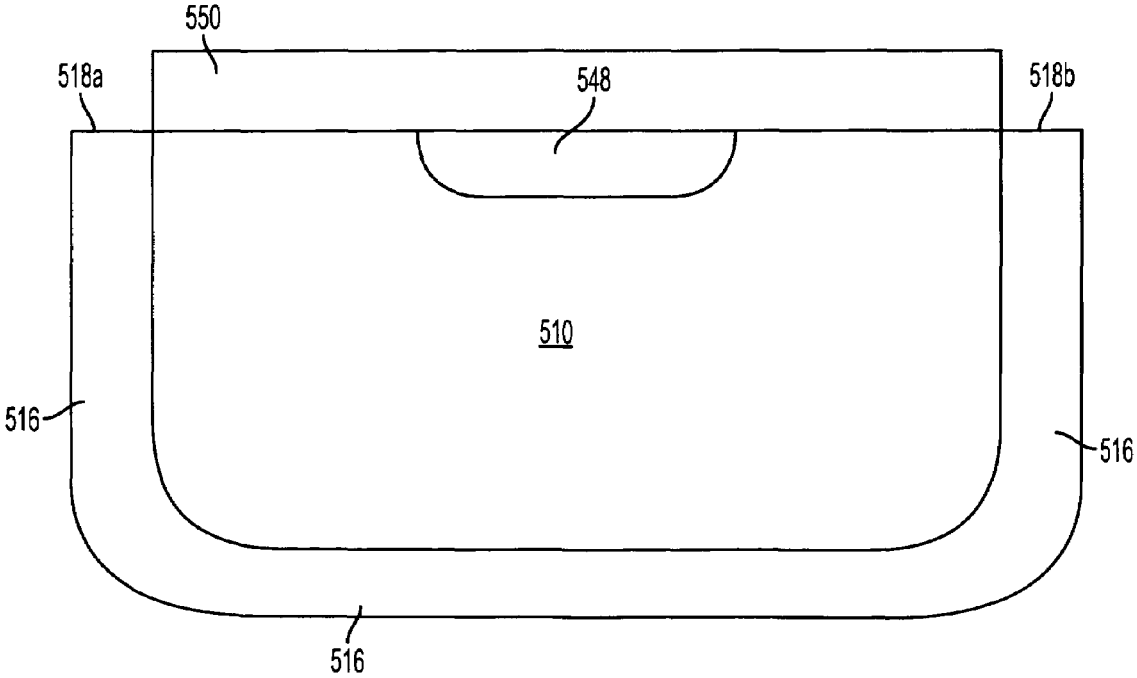
FIG. 7*b* shows a plan view of the back support member.

As shown in FIG. 7*b*, a relief 516 is provided along an edge of the back support member 508. The relief 516 engages the upwardly extending members 530 and 532 of the support structure 504. Optionally, a through-hole 548 can be included in the tray surface 510 of the back support member 508 to provide easier gripping of the handle 550. When the back support member 508 is placed in a utility tray configuration, either of two back support member relief stops 518*a* and 518*b* engage with the upwardly extending members 530 and 532, respectively. The back support member relief stops 518*a* and 518*b* prevent the back support member 508 from rotating past a position that is horizontal to a floor.

The back support member 508 can be made of any material including but not limited to wood, plastic, and fiberglass. Alternatively, the back support member 508 can be made of materials such as steel when, for example, a heavier load is going to be placed on the back support member 508 or when the back support member is to be used to support a person, i.e., as a seat for a high chair with a person's feet resting on a seat 520 of the Teacher's Chair.

A method of using a teacher's chair can include providing a teacher's chair that has a support structure that supports a backrest. The backrest can include a clothes-hanger and the support structure can slidingly engage with a tub. The method of using the teacher's chair should involve sliding the tub out of the support structure, inserting an item into the tub and then sliding the tub back into the support structure. Additionally, the clothes-hanger should be used as a handle to help in relocating the teacher's chair.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. For example, one or more elements can be rearranged and/or combined, or additional elements may be added. Thus, the present invention is not intended to be limited to the embodiments shown herein but is to be accorded the widest scope consistent with the principles and novel features disclosed herein.

We claim:

1. A chair comprising:

a support assembly having two upwardly extending members;

a handle between said two upwardly extending members; and a back support member rotatable about an axis defined by the handle and being integrally connected at an edge of said back support member to said handle and being reconfigurable between a first backrest position and a second tray position.

2. A chair as recited in claim 1 wherein said second tray position is parallel to a floor.

3. A chair as recited in claim 1 further comprising a clothes-hanger positioned on a top portion of said support assembly.

4. A chair as recited in claim 1 further comprised of at least one storage compartment in sliding communication with an interior portion of the support assembly.

5. A chair as recited in claim 4 wherein said at least one storage compartment is a hanging file folder system.

6. A chair as recited in claim 1 further comprising at least a first additional storage compartment in sliding communication with an interior portion of said support assembly.

7. A chair as recited in claim 6 further comprising at least a second additional storage compartment on said back surface of said back support member.

8. A chair as recited in claim 7 wherein said at least a second additional storage compartment is comprised of at least one vertical file rack.

9. A chair as recited in claim 4 wherein said at least one storage compartment is comprised of at least one detent mechanism that prevents said at least one storage compartment from inadvertently sliding out of said support assembly.

10. A chair as recited in claim 1 further comprising a footrest on a front portion of said support assembly.

11. A chair as recited in claim 1 wherein said support assembly further comprises casters.

12. A chair as recited in claim 1 further comprised of a hook integrated into said clothes hanger.

13. A teacher chair comprising:

a wheeled support structure having at least two upwardly extending members;

a back support member positioned between said at least two upwardly extending members, wherein said back support member is rotatable in an arc of approximately 225° over an axis defined by terminal ends of the at least two upwardly extending members from a back rest position to a utility tray position; and a file drawer encompassed by said wheeled support structure.

14. A chair as recited in claim 13 further comprised of a clothes-hanger positioned on a top portion of a back surface of said backrest.

15. A chair as recited in claim 13 further comprised of two opposing sliding tracks within said support structure, said two opposing sliding tracks slidingly supporting said file drawer.

16. A chair as recited in claim 15 further comprising a storage tub within said support structure.

17. A chair as recited in claim 16 further comprised of second two opposing sliding tracks within said support structure, said second two opposing sliding tracks in sliding communication with said tub.

18. A chair as recited in claim 13 further comprised of at least one vertical file rack positioned on a back side of said support structure.

19. A chair as recited in claim 13 further comprising a footrest on a front portion of said support structure.

20. A chair as recited in claim 13 wherein said back support member is comprised of a back support member relief, wherein said back support member relief is in communication with said upwardly extending members when said back support member is in a back rest position.

21. A chair as recited in claim 20 wherein said back support member is further comprised of at least one back support member relief-stop at an end of said back support member relief, wherein said back support member relief-stop is in communication with said upwardly extending members when said back support member is in a utility tray position.

22. A chair as recited in claim 13 wherein said back support member is comprised of a substantially planar tray surface.

* * * * *